United States Patent [19]

Tsubata

[11] 4,110,960

[45] Sep. 5, 1978

[54] METHOD AND APPARATUS FOR PIECING-UP THE BROKEN YARN IN AN OPEN-END SPINNING SYSTEM

[75] Inventor: Kazuo Tsubata, Kyotoshi, Japan

[73] Assignee: Hironori Hirai, Nagaokakyoshi, Japan

[21] Appl. No.: 512,973

[22] Filed: Oct. 7, 1974

[30] Foreign Application Priority Data

Oct. 11, 1973 [JP] Japan ..... 48-115044

[51] Int. Cl.[2] ..... D01H 15/00; D01H 1/12

[52] U.S. Cl. ..... 57/34 R; 57/156

[58] Field of Search ..... 57/34 R, 58.89–58.95, 57/156

[56] References Cited

U.S. PATENT DOCUMENTS 3,601,969 8/1971 Susami et al. ..... 57/58.91

3,680,300 8/1972 Landwehrkamp ..... 57/34 R 3,803,823 4/1974 Niestroj et al. ..... 57/34 R

*Primary Examiner*—John Petrakes

*Attorney, Agent, or Firm*—Whittemore, Hulbert & Belknap

[57] ABSTRACT

The present invention relates to a method and an apparatus for piecing up the broken end of yarn which is being spun by an open-end spinning machine. The end yarn is introduced into a rotor a predetermined time after the rotor has again been started into rotation for piecing up the broken yarn and within the time when the rotor is in acceleration and has not as yet attained its high spinning speed. Then, the yarn end is joined to fiber material supplied into the rotor, while the twist of the yarn is still insufficient, and the centrifugal force applied to the yarn has not attained its maximum value.

4 Claims, 7 Drawing Figures

METHOD AND APPARATUS FOR PIECING-UP THE BROKEN YARN IN AN OPEN-END SPINNING SYSTEM

BACKGROUND OF THE INVENTION

The present invention relates to a method and an apparatus piecing up broken yarn in an open-end spinning system. The most important feature of the present invention is that the yarn end ready for yarn piecing up is introduced at each piecing up operation into a rotor after the lapse of a predetermined time since the rotor which has so far been braked is released from the braking pressure and started into revolution. When the rotor is released from its brake shoe and contacted with a moving belt, the rotor is revolved with a gradually increasing speed until it reaches a designated speed.

According to the present invention, the yarn end is introduced into the rotor while the latter is still in the course of its acceleration. When the rotor is revolved at an extremely high speed, as for instance at 70,000 r.p.m., the yarn end is twisted instantly due to high-speed revolution of the rotor when the yarn end is introduced into the rotor for piecing up. Moreover, the yarn is subjected to a high shearing stress due to the large centrifugal force caused by the rotor revolution, thus causing twist breakages. In effect, with 70,000 r.p.m. of the rotor, the rate of successful yarn piecing up is reduced at most to 1 percent. The present invention envisages to obviate such inconvenience by introducing the yarn end into the rotor for joining with the fiber material while as yet the yarn end is not twisted sufficiently and the centrifugal force exerted to the yarn end has not attained the maximum value.

DETAILED DESCRIPTION OF THE INVENTION

Figure 1:
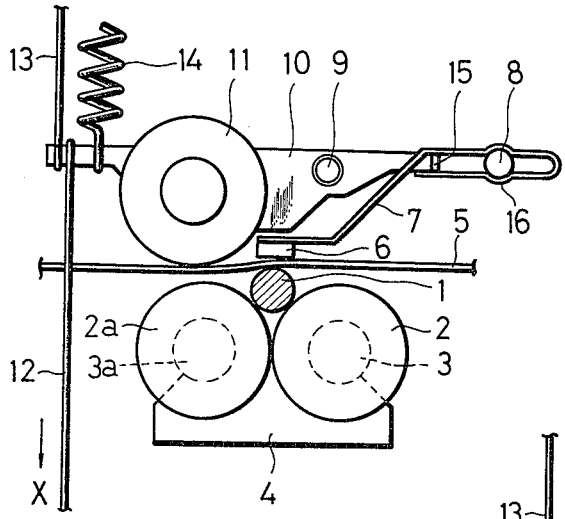
FIGS. 1 and 2 are the explanatory views showing the operation of the driving unit for the rotor.

According to the present invention, the yarn end is introduced into the rotor for intertwining with the sliver-like fiber material while the rotor is revolved at a slower speed and the tension as well as twist given to the yarn end is still insufficient. The present invention enables positive intertwining of the yarn with the sliver-like material and provides a high percentage of success in yarn piecing up even when the yarn is spun at a high spinning speed.

The object of the present invention is to provide a method for yarn piecing up, by means of which the yarn piecing up may be accomplished with a high rate of success and the uniform yarn quality in the neighborhood of the ended portion may be attained.

The designated time for introducing the yarn end into the rotor can be changed for each spinning unit and the failure in yarn piecing up may be prevented from occurring frequently in a certain unit or units.

The basic feature of the present invention resides in that the rotor is accelerated and the yarn end is introduced into the rotor in the course of its acceleration. The rotor may be accelerated gradually by contacting a belt or the rotor with the rotor shaft frictionally and utilizing the slip acting between the contacting parts or by connecting a variable speed electric motor to each rotor of the spindle. The time necessary for accelerating the rotor may be changed by varying the manner of contact between the belt and the rotor shaft, contact angle, belt width, belt tension, the weight of the rotor or the rotor shaft and so forth, or by changing the speed of the electric motor in case the spindle rotor is coupled directly to the electric motor.

According to the present invention, the yarn end has been introduced into the rotor when it has arrived at the fiber-collecting surface of the rotor or, more precisely, when it has arrived at the said surface from a zone in the interior of the rotor where the yarn end may be acted on by the suction air current prevailing in the rotor. It is essential that the yarn end should be introduced into the rotor precisely at the time that the rotor has been accelerated to substantially the same number of revolutions for each yarn piecing up operation. The number of revolutions for yarn piecing up may be selected in a range of $\pm$ 1000 r.p.m. At trial yarn piecing up operations, the highest rate of success in the piecing up operation was attained when the yarn end was introduced into the rotor revolving at 20,000 to 40,000 r.p.m. According to the preferred embodiments of the yarn release mechanism according to the present invention, the yarn end is introduced into the rotor after a predetermined time from the release of brake pressure to the rotor, that is, when the latter has been accelerated to a fixed number of revolutions for each yarn piecing up operation.

In the following embodiments, the rotor is braked by a brake shoe applied to the rotor shaft, but the present invention is not limited to such mode of brake application.

FIG. 1 is a front elevation showing a rotor shaft 1 mounted integrally to a rotor revolved at an ordinary spinning speed, although the rotor has been omitted in the drawing. The numeral 10 denotes an accelerator lever swingably mounted by a pivot pin 9 and carrying a tension pulley 11 rotatable about a pivot shaft, not shown. This tension pulley serves for pressing a belt 5 onto the rotor shaft 1 for rotating the latter by frictional contact with the moving belt 5. The tension pulley 11 is pressed on the belt 5 when a string 12 associated with the accelator lever 10 is pulled during the normal spinning operation. When the string 12 is slacked, the accelerator lever 10 is pivoted clockwise about pivot pin 9, under the effect of a tension spring 14, so as to disengage the tension pulley 11 from the belt 5. At such time a bent portion 15 provided on the lever 10 is lowered to position a spring plate 7 associated therewith so that a brake shoe 6 secured to the spring plate 7 is pressed to the rotor shaft 1 for brake application. The numeral 8 denotes a fixed pin serving as an axis of revolution of the spring plate which is held between the arcuate portions 16 of the U-shaped end part of the spring plate 7. The numerals 2, **2*a* denote a pair of rubber rollers placed adjacent to each other and carrying the rotor shaft 1 in a wedge-like space defined above the rollers 2, 2*a*. Although not shown, a further pair of similar rubber rollers are provided in the present embodiment for carrying the rotor shaft 1 in the same way as the rollers 2, 2*a***.

Figure 2:
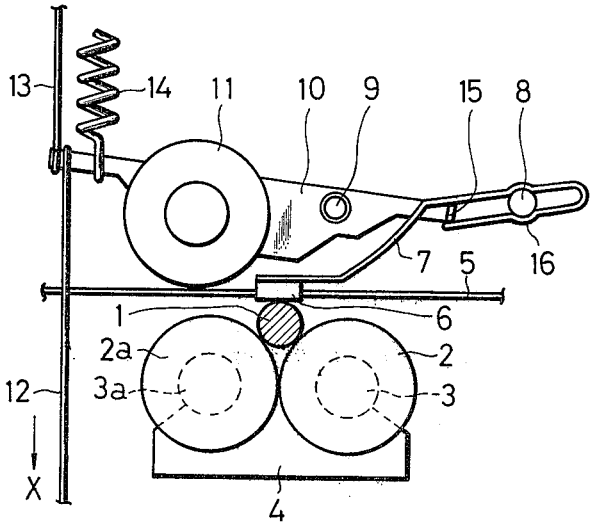

The numerals 3, 3*a* denote bearing means for carrying the rollers 2, 2*a* and the numeral 4 denotes a bearing block. In FIG. 2, the string 12 is slacked in the direction opposite to that of the arrow mark X for braking the rotor shaft 1. When the string 12 is pulled in the direction of the arrow mark X from the braking position shown in FIG. 2, the tension pulley 11 presses the belt 5 onto the rotor shaft 1 and the latter starts to rotate. The rotor shaft 1 is then gradually accelerated in its rotation until finally it attains the same peripheral speed as that of the moving belt 5.

The time interval required for accelerating the rotor shaft 1 and hence the rotor can be adjusted by shifting the mounting positions of the pivot pin 8 and/or the pivot pin 9 for changing the pressure applied by the brake shoe 6 and/or the tension pulley 11 to the moving belt 5. At this time, the frictional contact pressure between the belt 5 and the rotor shaft may be changed naturally so as to adjust the speed-up time for the rotor. Alternatively, the string 12 may be pulled at varying speeds in the direction of the arrow mark X to adjust such speed-up time. Also, to this end, the weight of the rubber rollers 2, 2*a* and/or the rotor shaft 1 and/or rotor may be changed for changing their inertia force. The string 12 can be pulled or slacked by operation of a lever mechanism, not shown. The string 12 has an extension 13 which is also associated with the accelerator lever 10 and which may be pulled or slacked by the corresponding movement of the string 12. The extension 13 may be replaced by a link or a lever of a separate motion transmitting device.

Figure 3:
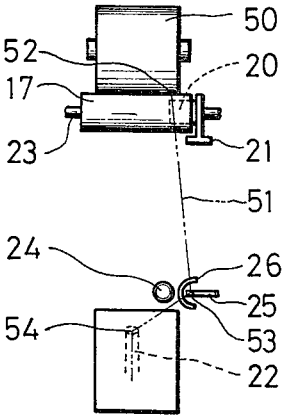
FIG. 3 is an explanatory view showing the mode of deviation of the yarn.

FIG. 3 shows the manner in which the yarn end is introduced into the interior of the rotor during the speed-up time of the rotor shaft and the rotor. In FIG. 3, yarn 51 reeled out from a cheese 50 at a contact point 52 between a winding drum and the cheese is passed around a side 53 of a pin 19 adapted for deviating the yarn, so that the yarn end is disposed in a yarn discharge tube 22 adjacent to its inlet 54. The yarn end is sucked there into the interior of the discharge tube 22 under the effect of a suction air current induced inside the tube. The yarn end can be maintained out of direct contact with the collecting surface of the rotor by shifting the pin 19 to a proper position. The yarn end is now ready to be pieced up or connected with the fibers supplied into the rotor. The rotor is now started again from its stationary state by pulling the string 12 in the direction of the arrow mark X as shown in FIG. 2. At this time, the brake shoe 6 is disengaged from the rotor shaft 1, at the same time that the tension pulley 11 is applied to the belt 5 for pressing the latter onto the rotor shaft 1. After lapse of a fixed time from the string 12 being pulled in the direction of the arrow mark X from the position shown in FIG. 2 to that shown in FIG. 1, the yarn 51 is disengaged from the pin 19 and subjected to the suction air current prevailing within the tube 22. The yarn 51 is sucked further into the tube 22 and arrives finally at the collecting surface of the rotor. The yarn 51 is shifted from the path 52, 53, 54 to path 52, 54 and rotated together with the revolving rotor. At this time, the yarn is placed under a tension due to the centrifugal force and activates a yarn tension sensor or feeler, not shown, mounted at the exit 54 of the yarn discharge tube. Thus an electric contact, not shown, is closed and the supply of silver into the interior of the rotor is started by operation of an electrically actuated supply device associated with the electric contact. A magnetic clutch 20 enclosed inside the winding drum 17 is connected after a certain time after the supply of sliver is started, so that the rotation of the winding drum 23 is transmitted to the winding drum 17 to start the winding of the yarn 51. The mechanism for releasing the yarn 51 from the pin 19 may be designed in such a manner that the accelerator lever 10 shown in FIG. 1 acts on a limit switch, not shown, and a solenoid, also not shown, is thereby energized after some fixed time from the corresponding electric signal being transmitted from the limit switch so as to shift the pin 19 to some remote position. However, this yarn release mechanism may be designed as shown in FIGS. 4 to 7 for lowering the manufacture cost and realizing a more positive and reliable operation.

Figure 4:
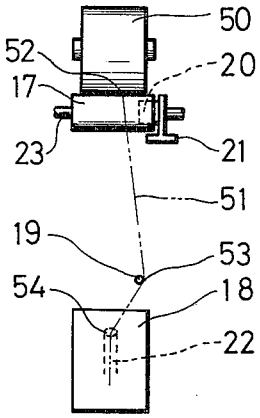
FIG. 4 is a front view showing a first embodiment of the yarn release mechanism.
Figure 5:
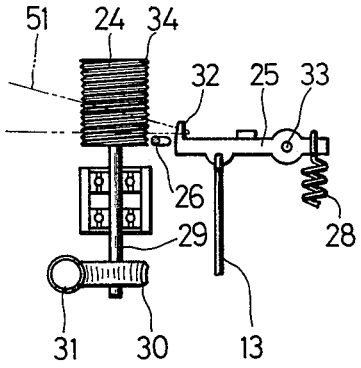
FIG. 5 is a plan view thereof.

In FIGS. 4 and 5, a roller 24 is provided with screw threads on its peripheral surface and rotated at a constant speed. An adjustment pin 26 is positioned at a small distance from the threaded surface of the roller 24 so as to support the yarn 51 from the bottom side. A yarn gripping lever 25 having a projection 32 is positioned at some distance from the adjustment pin 26 at the side opposite to the roller 24. In the present embodiment, the yarn delivered through the contact point 52 between the cheese 16 and the winding drum 17 is hooked on the projection 32 of the gripping lever 25 and sucked into the interior of the rotor under the force of the suction air current. The yarn 51 is now ready to be pieced up with the new yarn.

FIG. 5 shows the yarn release mechanism of the embodiment in detail. In FIG. 5, a worm 31 driven permanently from a drive source, not shown, meshes with a helical worm gear 30 so as to rotate a shaft 29 and the screw cylinder 24 united integrally with the shaft 29. The lever 25 is mounted pivotally about pin 33 and connected to the upper end of the extension 13 of the string 12 shown in FIG. 1 and to a compression spring 28. When the string 12 is pulled in the direction of the arrow mark X for starting the rotor, the extension 13 of the string 12 is pulled simultaneously and the lever 25 is turned counterclockwise about pivot pin 33 to release the yarn 51 so far held by the projection 32. The yarn 51 is then guided along the adjustment pin 26 and drops onto the bottom of the screw thread formed on the screw cylinder 24. The screw cylinder 24 is rotated in a direction such that the yarn dropped onto the bottom of the screw thread on the cylinder 24 is guided by the screw thread towards the upper end 34 of the cylinder 24 and disengaged from the cylinder 24. The yarn 51 is now sucked further into the interior of the discharge tube 22 and gets to the collecting surface of the rotor. The mounting positions of the adjustment pin 26 and the pivot pin 33 can be designed properly so that the yarn 51 may drop onto the bottom of the screw thread on the screw cylinder 24 at the desired position. Hence, by proper selection of the number of revolution of the screw cylinder 24 and/or the pitch of the screw thread for the selected positions of the adjustment pin 26 and the pivot pin 33, the yarn 51 can be disengaged from the hook position 32 shown in FIG. 4 and introduced further into the discharge tube 22 after a desired time since the rotor is started by pulling the string 12.

Figure 6:
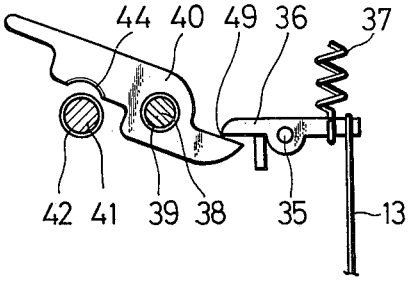
FIG. 6 is a side view showing a second embodiment of the yarn release mechanism.
Figure 7:
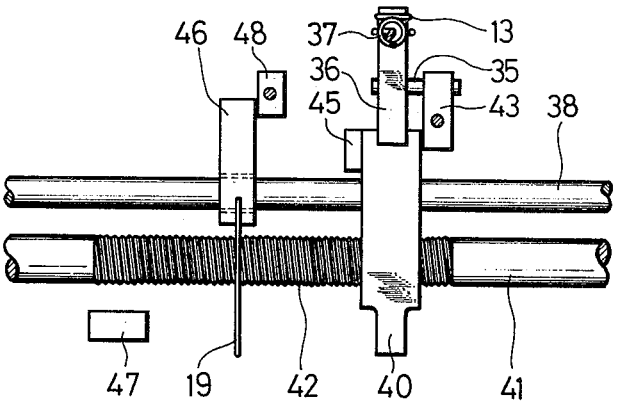
FIG. 7 is a plan view thereof.

In the embodiment shown in FIGS. 4 and 5, the yarn 51 is released from the hook position 32 and introduced instantly into the rotor. In another modified embodiment shown in FIGS. 6 and 7, the yarn is released from the pin 19 and introduced gradually and smoothly into the rotor to ensure more positive yarn piecing up. In FIGS. 6 and 7, the numeral 41 denotes a screw shaft formed with screw thread 42, and the numeral 40 a carrier fitted with a metal bushing 39 and slidable along a fixed shaft 38. Said carrier 40 is formed on its lower surface with a female thread 44 mating with the screw thread 42 of the screw shaft 41. The screw shaft 41 and the fixed shaft 38 are so arranged relative to each other that when the carrier 40 is revolved counterclockwise about the fixed shaft 38 and abuts on the shaft 41, the screw thread 42 comes into correct meshing with the mating screw thread 44 formed on the lower surface of the carrier 40. Thus when the threads 42, 44 are placed in a meshing relation, and the screw shaft is revolved in the direction of feed of the screw thread 42, the carrier 40 provided with the thread 44 is slid in an opposite direction to that of feed of the screw thread 42. A magnet 45 is fixedly mounted to the carrier 40. As the carrier 40 is moved along the fixed shaft 38 by rotation of the screw shaft, it abuts on a slider 46 mounted on the fixed shaft 38 ahead of the carrier 40 and is moved further forwards together with the slider 46 along the fixed shaft 38. The slider 46 is formed integrally with the pin 19 (FIG. 3). The yarn 51 is hooked on this pin 19 and sucked into the discharge tube so as to be ready for yarn ending. The numerals 43, 48 in FIG. 7 denote setting blocks adapted to engage the carrier 40 and the slider 46 on their lateral surfaces respectively, for setting their initial positions.

In operation, while the brake is applied to the rotor, the string 12 is moved in a direction opposite to that shown by the arrow mark X, and shifted to the position shown in FIG. 2. The extension 13 of the string 12 is thus slacked and a lever 36 associated with the extension 13 is pulled by a compression spring 37 to a position shown in FIG. 6. This lever 36 is pivotably mounted by a pivot pin 35 and engaged at one end with the end of the carrier 40. When the string 12 is pulled in the direction of the arrow mark X to the position of FIG. 1 so as to release the brake supplied to the rotor, and the latter is set into revolution. The extension 13 is also pulled in the same direction as the string 12, and the lever 36 is pivoted with the pivot pin 35 as center. The carrier 40 is now disengaged from the lever 36 and pivoted counterclockwise about the pivot shaft 38. In the present embodiment, the carrier 40 is pivoted under its own weight, but a spring or a magnet may be provided to effect pivoting of the carrier. When the carrier 40 is pivoted in this way, and the threads 42, 44 mesh with each other, since the shaft 41 is revolved continuously, the carrier 40 is fed in an opposite direction to that of feed of the screw thread 42 or towards the slider 46, until the magnet 45 contacts the slider 46. From this time the carrier 40 with the magnet 45 is moved along with the slider 46. Thus the yarn 51 hooked by the pin 19 is supplied gradually into the interior of the rotor under the effect of the suction air current provided in the discharge tube. When the end of the yarn 51 gets to the collecting surface of the rotor, some tension is placed on the yarn, and the slider 46 tends to be pulled in its advancing direction. In effect, the slider 46 is attracted by the magnet 45, and both the movement of the slider 46 and the delivery of the yarn 51 into the rotor are regulated by the speed of revolution of the screw shaft 41, even after the tension is placed on the yarn. As the slider 46 is moved further with revolution of the screw shaft 41, and the pin 19 has passed beyond the discharge tube 22, the carrier 40 rides on the inclined surface of a fixed taper block 47. Thus, the threads 42, 44 are disengaged from each other, and the carrier 40 is brought to a stop.

In this embodiment, the time interval that elapses since the rotor is started upon release of the brake pressure and until the yarn end arrives at the collecting surface of the rotor can be set by properly selecting the number of revolutions of the shaft 41 and/or the positions of the setting blocks 43, 48 and/or the pitch of the screw threads 42, 44. When the carrier 40 and the slider 46 are set to their initial positions, the carrier 40 is pivoted slightly about pivot shaft 38 and displaced to the right in the drawing until it abuts on the setting block 43. At this time, the slider 46 is attracted to the magnet 45 and displaced together with the carrier 40 until it abuts on the setting block 48 and may be finally stopped.

In this embodiment, the slider 46 is pushed along the fixed shaft 38 by the carrier 40 driven by the screw shaft, but the mounting positions of the carrier 40 and the slider 46 may be reversed from those shown in FIG. 7 so that the slider is pulled by a long arm provided on the rear side of the carrier, or alternatively the pin 19 may be fixed directly to the carrier 40.

What is claimed is:

1. An apparatus for piecing up yarn ends in a spinning machine including a rotor, a yarn discharge tube and a winding drum comprising, an accelerator lever operably associated with the rotor for accelerating the rotor, a yarn gripping lever for holding a broken end of the yarn in a deviated state between the yarn discharge tube and the winding drum, a string operably associated with said accelerator lever and with said yarn gripping lever for controlling rotation of said rotor and release of said yarn by said gripping lever, and a positively revolved screw cylinder for holding the yarn in the deviated state for a predetermined time after the yarn is released from said gripping lever.

2. An apparatus for piecing up yarn ends in a spinning machine including a rotor, a yarn discharge tube and a winding drum, comprising a pin for holding a yarn end in a deviated state between the yarn discharge tube and the winding drum, an accelerator lever operably associated with the rotor for accelerating the rotor, a starter lever, a string operably associated with said accelerator lever and with the starter lever for controlling rotation of said rotor and release of the yarn by said pin, a positively driven screw shaft, and a carrier associated with said starter lever for meshing with the positively driven screw shaft when said starter lever is actuated, and for moving therealong for releasing the end of the yarn from said pin.

3. A method for piecing up the ends of yarn being spun by an open end spinning machine, which spinning machine includes a rotor, a yarn discharge tube, a winding drum and apparatus for piecing up the yarn ends, comprising an accelerator lever operably associated with the rotor for accelerating the rotor, a yarn gripping lever for holding the broken end of the yarn in a deviated state between the yarn discharge tube and the winding drum, a string operably associated with said accelerator lever and with said yarn gripping lever for controlling rotation of said rotor and release of said yarn by said gripping lever, and a positively revolved screw cylinder for holding the yarn in the deviated state for a predetermined time after the yarn is released from said gripping lever, which method for piecing up the ends of the yarn comprises the steps of driving the rotor of the open end spinning machine in an accelerating mode on actuation of the accelerator lever, holding a broken end of yarn in a deviated state between the yarn discharge tube and the winding drum of said open end spinning machine by means of the yarn gripping lever for a predetermined designated time after the start of acceleration of the rotor, which predetermined time is determined by the positively revolved screw cylinder, releasing the yarn end from the yarn gripping device after the predetermined time by means of the string and accelerator lever and introducing the yarn end into the discharge tube of the rotor after said predetermined time.

4. A method for piecing up the ends of yarn being spun by an open end spinning machine, which spinning machine includes a rotor, a yarn discharge tube, a winding drum and apparatus for piecing up the yarn ends, comprising accelerating means operably associated with the rotor for accelerating the rotor, yarn gripping means for holding the broken end of the yarn in a deviated state between the yarn discharge tube and the winding drum, control means operably associated with said accelerating means and with said yarn gripping means for controlling rotation of said rotor and release of said yarn by said gripping means, and timing means for positively holding the yarn in the deviated state for a predetermined time after the yarn is released from said gripping means, which method for piecing up the ends of the yarn comprises the steps of driving the rotor of the open end spinning machine in an accelerating mode on actuation of the accelerating means, holding the broken end of yarn in a deviated state between the yarn discharge tube and the winding drum of said open end spinning machine by means of the yarn gripping means for a predetermined designated time after the start of acceleration of the rotor, which predetermined time is determined by the timing means, releasing the yarn end from the yarn gripping means after the predetermined time by means of the control means and introducing the yarn end into the discharge tube of the rotor after said predetermined time.

* * * * *